United States Patent [19]

Aboelfotoh

[11] 4,207,488

[45] Jun. 10, 1980

[54] DIELECTRIC OVERCOAT FOR GAS DISCHARGE PANEL

[75] Inventor: Mohamed O. Aboelfotoh, Poughkeepsie, N.Y.

[73] Assignee: International Business Machines Corporation, Armonk, N.Y.

[21] Appl. No.: 811,745

[22] Filed: Jun. 30, 1977

[51] Int. Cl.[2] ..... H01J 61/30

[52] U.S. Cl. ..... 313/221; 313/218

[58] Field of Search ..... 313/188, 218, 221, 220

[56] References Cited

U.S. PATENT DOCUMENTS

| | | | |
|---|---|---|---|
| 3,846,670 | 11/1974 | Schaufele | 315/169 TV |
| 3,852,607 | 12/1974 | Hoehn et al. | 313/221 X |
| 3,863,089 | 1/1975 | Ernsthauson et al. | 313/201 |
| 3,932,920 | 1/1976 | Ernsthausen | 313/201 X |
| 3,989,982 | 11/1976 | Schaufele | 315/169 TV |
| 4,028,578 | 6/1977 | Byrum et al. | 313/221 |
| 4,114,064 | 9/1978 | Ernsthausen | 313/188 |

OTHER PUBLICATIONS

IBM Technical Disclosure Bulletin, Mar. 1975, pp. 2953–2954.

*Primary Examiner*—Rudolph V. Rolinec
*Assistant Examiner*—Darwin R. Hostetter
*Attorney, Agent, or Firm*—Joseph J. Connerton

[57] ABSTRACT

A high resolution gaseous discharge display and/or memory device comprises a panel array of bistable charge storage areas designated gaseous discharge cells or sites, each cell having an associated pair of coordinate orthogonal conductors defining the cell walls which, when appropriately energized, produce a confined gaseous discharge in the selected sites. The conductors are insulated from direct contact with the gas by a dielectric insulator, the dielectric insulator being composed of a layer of refractory material having high secondary emission characteristics such as a Group IIA oxide doped with lithium a Group IA element, to prevent degradation of the dielectric during operation, to increase the static margin of the panel and improve the stability of the maximum and minimum sustain voltages, thereby providing stable operating voltages and extending the life of the gaseous discharge panel. Other embodiments of the dielectric insulator utilize additional small concentrations of elements of Groups VIII or V1B with the above combination.

9 Claims, 2 Drawing Figures

DIELECTRIC OVERCOAT FOR GAS DISCHARGE PANEL

CROSS REFERENCE TO RELATED APPLICATIONS

U.S. Application Ser. No. 405,205 filed by Peter H. Haberland et al, Oct. 10, 1973, now U.S. Pat No. 3,837,724.

U.S. Application Ser. No. 372,384 for "Improved Method and Apparatus for a Gas Display Panel" filed by Tony N. Criscimagna et al, June 21, 1973.

Application Ser. No. 636,180 "Improved Dielectric for Gas Discharge Panel" filed by Mohammed O. Aboelfotoh et al, Nov. 28, 1975, now U.S. Pat. No. 4,053,804.

Application Ser. No. 736,802 "Improved Gas Panel Assembly" filed by Mohammed O. Aboelfotoh et al, Oct. 29, 1976, now U.S. Pat. No. 4,053,614.

Application Ser. No. 703,382 "Glass Layer Fabrication" filed by K. C. Park et al, July 7, 1976, now U.S. Pat. No. 4,104,418.

BACKGROUND OF THE INVENTION

Plasma or gaseous discharge display and/or storage apparatus have certain desirable characteristics such as small size, thin flat display package, relative low power requirements and inherent memory capability which render them particularly suitable for display apparatus. One example of such known gaseous discharge devices is disclosed in U.S. Pat. No. 3,559,190, "Gaseous Display and Memory Apparatus", patented Jan. 26, 1971 by Donald L. Bitzer et al and assigend to the University of Illinois. Such panels, designated a.c. gas panels, may include an inner glass layer of physically isolated cells or comprise an open panel configuration of electrically insulated but not physically isolated gas cells. In the open panel configuration, which represents the preferred embodiment of the instant invention, a pair of glass plates having dielectrically coated conductor arrays formed thereon are sealed with the conductors in substantially orthogonal relationship. When appropriate drive signals are applied to selected pairs or groups or conductors, the signals are capacitively coupled to the gas through the dielectric. When these signals exceed the breakdown voltage of the gas, the gas discharges in the selected area, and the resulting charge particles, ions and electrons, are attracted to the wall having a potential opposite the polarity of the particle. This wall charge potential opposes the drive signals which produce the discharge, rapidly extinguishing the discharge and assisting the breakdown of the gas in the next alternation. Each discharge produces light emission from the selected cell or cells, and by operating at a relaively high frequency in the order of 30-40 kilocycles, a flicker-free display is provided. After initial breakdown, the discharge condition is maintained in selected cells by application of a lower potential designated the sustain signal which, combined with the wall charge, causes the selected cells to be reignited and extinguished continuously at the applied frequency to maintain a continuous display.

The capacitance of the dielectric layer is determined by the thickness of the layer, the dielectric constant of the material and the geometry of the drive conductors. The dielectric material must be an insulator having sufficient dielectric strength to withstand the voltage produced by the wall charge and the externally applied potential. The dielectric surface should be a relatively good emitter of secondary electrons to assist in maintaining the discharge, be transparent or translucent on the display side to transmit the light generated by the discharge for display purposes, and be susceptible to fabrication without reacting with the conductor metallurgy. Finally, the coefficient of expansion of the dielectric should be compatible with that of the glass substrate on which the dielectric layer is formed.

One material possessing the above characteristics with respect to a soda-lime-silica substrate is lead-borosilicate solder glass, a glass containing in excess of 75 percent lead oxide. In an embodiment constructed in accordance with the teaching of the present invention, a dielectric comprising a layer of lead-borosilicate glass was employed as the insulator. However, chemical and physical reaction on the surface of the dielectric glass under discharge conditions produced degradation or decomposition of the lead oxide on the dielectric surface, thereby producing variations in the electrical characteristics of the gaseous display panel on a cell-by-cell basis. This degradation, resulting primarily from ion bombardment of the dielectric surface, caused the electrical parameters of the individual cells in the gaseous discharge device to vary as a function of the cell history such that over a period of time, the required firing voltage for individual cells fell outside the normal operating range, and the required firing voltage varied on a cell-by-cell basis.

In order to avoid degradation of the dielectric surface resulting from ion bombardment in a gaseous discharge device, a layer of refractory material having a high binding energy has been utilized in the prior art to protect the dielectric surface. A refractory material is one which resists ordinary treatment, is difficult to reduce and has a high binding energy, such that its constituents remain constant even after prolonged use. It is also known in the art that the breakdown voltage in a gaseous discharge device may be lowered by utilizing a refractory material having a high coefficient of secondary emmission such as magnesium oxide.

The conventional gas panel fabrication and test process employs a significant burn-in time in the general order of 16 hours as the final fabrication step. When alternate line testing in which operating potentials are applied to alternate lines was employed to test panels having a magnesium oxide dielectric surface, the maximum and minimum sustain signals tend to converge, resulting in a lowering of the memory margin, i.e., the difference between the maximum sustain voltage of the operated cells and the minimum sustain voltage, of the non-operated cells was noted. This phenomenon, known as alternate line aging, reduced the memory margin of the tested cells below acceptable limits, resulting in rejection of a substantial number of panels producing lower yield and higher cost.

SUMMARY OF THE INVENTION

In accordance with the instant invention, magnesium oxide, a refractory material characterized by a high coefficient of secondary emission, is doped with lithium a Group IA element and applied over the entire surface of the dielectric layer. By utilizing magnesium oxide, the secondary electron emission characteristics dominate the electric operating conditions in the gas panel, resulting, as more fully described hereinafter, in gaseous discharge operation with lower operating voltages.

Doping the magnesium oxide overcoat with elements of Group IA such as lithium or with lithium and small concentrations of elements of Group VIII (e.g., iron or nickel) or Group VIB (e.g., chromium) results in substantially no change in the maximum and minimum sustain voltage during test or aging. The lithium concentration, which may vary from 5 to 40 atomic percent, significantly improves the stability of $V_{s\,max.}$ with panel operating time, thereby extending the useful life of the gas panel. The memory margin of the cells is increased by increasing the maximum sustain voltage at a higher rate than that of the minimum sustain voltage. The alternate line aging problem is eliminated, thereby increasing the panel yield and minimizing rejection of panels with inadequate memory margin.

Accordingly, a primary object of the present invention is to provide an improved gaseous discharge display panel.

Another object of the present invention is to provide an improved gaseous discharge display panel utilizing a surface of lithium doped magnesium oxide adjacent to and in continuous contact with the gas to improve the memory margin of the device.

Still another object of the present invention is to provide an improved gaseous discharge display panel having a layer of lithium doped magnesium oxide in contant with the gas to prevent degradation of the dielectric material, to eliminate aging effects and thereby extend panel life and to stabilize the operating potentials required for gas panel operation.

Another object of the instant invention is to provide an improved gas panel assembly adapted to eliminate the alternate line aging problem.

The foregoing and other objects, features and advantages of the present invention will be apparent from the following description of a preferred embodiment of the invention as illustrated in the accompanying drawings.

DESCRIPTION OF A PREFERRED EMBODIMENT

Figure 1:
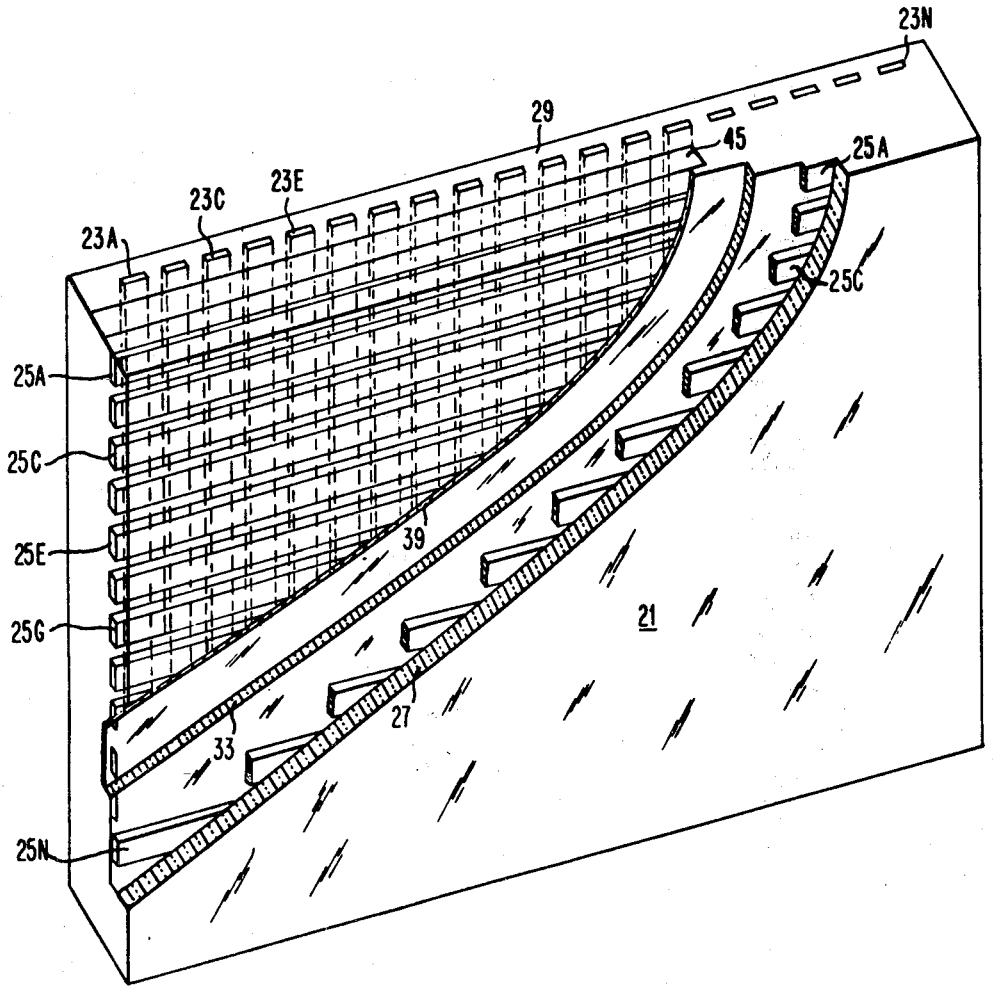
FIG. 1 is an isometric view of a gaseous discharge panel broken away to illustrate details of the present invention.

Referring now to the drawings and more particularly to FIG. 1 thereof, there is illustrated a gas panel 21 comprising a plurality of individual gas cells or sites defined by the intersection of vertical drive lines 23A–23N and horizontal drive lines 25A–25N. The structure of the preferred embodiment as shown in the drawings is enlarged, although not to scale, for purposes of illustration; however, the physical and electrical parameters of the invention defined in the instant application are fully described in detail hereinafter. While only the viewing portion of the display is illustrated in the interest of clarity, it will be appreicated that in practice the drive conductors extend beyond the viewing area for interconnection to the driving signal source.

The gas panel 21 includes an illuminable gas such as a mixture of neon and argon within a sealed structure, the vertical and horizontal conductor arrays being formed on associated glass plates and disposed in orthogonal relationship on opposite sides of the structure. Gas cells within the panel are selectively ionized during a write operation by applying to the associated conductors coincident potentials having a magnitude sufficient when algebraically added to exceed the breakdown voltage $V_B$. In the preferred embodiment, the control potentials for write, read and erase operations may be square wave a.c. signals of the type described in aforenoted copending Application Ser. No. 372,384. Typical operating potentials for a gaseous discharge panel with nominal deviations using a neon-argon gas mixture are 150 volts for write, 93 to 99 volts for sustain $V_{s\,max.}$, and 82 volts for sustain minimum voltage $V_{s\,min.}$ Once the wall charge has been established, the gas cells are maintained in the discharge state by a lower amplitude periodic sustain signal. Any of the selected cells may be extinguished, termed an erase operation, by first reducing the potential difference across the cell by neutralizing the wall charges so that the sustain signal is not adequate to maintain the discharge. By selective write operations, information may be generated and displayed as a sequence of lighted cells or sites in the form of alphanumeric or graphic data, and such information may be regenerated as long as desired by the sustain operation.

Since the dielectric or its associated overcoat interfaces directly with the gas, it may be considered a gas panel envelope comprising relatively thin or fragile sheets of dielectric material such that a pair of glass substrates 27, 29, front and rear, is employed as support members on opposite sides of the panel. The only requirement for such support members is that they be nonconductive and good insulators, and substantially transparent for display purposes. One-quarter inch thick commercial grade soda-lime-silica glass is utilized in the preferred embodiment.

Figure 2:
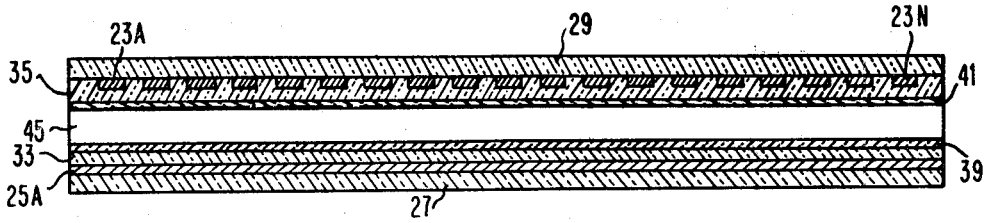
FIG. 2 is a top view of the gaseous discharge panel illustrated in FIG. 1.

Shown also in cutaway is conductor array 25 comprising conductors 25A–25N which are interposed between the glass substrate 27 and associated dielectric member 33. The corresponding configuration for conductor array 23 is illustrated in FIG. 2. Conductor arrays 23, 25 may be formed on substrates 27, 29 by a number of well known processes such as photoetching, vacuum deposition, stencil screening, etc. Transparent, semi-transparent or opaque conductive material such as tin oxide, gold, aluminum or copper can be used to form the conductor arrays, or alternatively the conductor arrays 23, 25 may be wires or filaments of copper, gold, silver or aluminum or any other conductive metal or material. However, formed in situ conductor arrays are preferred, since they may be more easily and more uniformly deposited on and adhere to the substrates 27, 29. In a preferred embodiment constructed in accordance with the instant invention, opaque chrome-copper-chrome conductors are utilized, the copper layer serving as the conductor, the lower layer of chrome providing adhesion to the associated substrate, the upper layer of chrome protecting the copper conductor from attack by the lead-borosilicate insulator during fabrication.

In the preferred embodiment herein described, dielectric layers 33, 35, layer 33 of which is broken away in FIG. 1, are formed in situ directly over conductor arrays 25, 23 respectively of an inorganic material having an expansion coefficient closely related to that of the substrate members. One preferred dielectric material, as previously indicated, is lead-borosilicate solder glass, a material containing a high percentage of lead oxide. To fabricate the dielectric, lead-borosilicate glass frit is sprayed over the conductor array and the substrate placed in an oven where the glass frit is reflowed and monitored to ensure appropriate thickness. Alternatively, the dielectric layer could be formed by electron beam evaporation, chemical vapor deposition or other suitable means. The requirements for the dielectric layer have been specified, but additionally the surface of the dielectric layers should be electrically homogeneous on a microscopic scale, i.e., should be preferably free from cracks, bubbles, crystals, dirt, surface films or any impurity or imperfection. For additional details relative to gas panel fabrication, reference is made to the aforenoted U.S. Pat. No. 3,837,724.

Finally, as heretofore described, the problem of degradation occurring on an unprotected dielectric surface during operation of the gas panel resulting from ion bombardment produced variation of the electrical characteristics of individual cells and significantly reduced panel life. The solution utilized in the preferred embodiment was the deposition of a homogeneous layer of magnesium oxide having a high secondary emission characteristic doped with lithium between the dielectric surface and the gas. This homogeneous layer is formed by co-evaporation of the lithium and magnesium oxides in an evaporation system of the type shown in FIG. 2 of the aforereferenced copending Application Ser. No. 703,382, the respective proportions of the constituents being determined by the respective evaporation rates. Such evaporations take place in the single evacuated chamber during a single pumpdown. Such a layer may comprise between 5 and 40 atomic percent lithium, the layer in the preferred embodiment being 3000 A° or 0.3 microns thick. Within this range, the minimum sustain voltage $V_{s\ min.}$ increases slightly, while the maximum sustain voltage $V_{s\ max.}$ has a greater increase as the percentage of lithium increases. In a preferred embodiment constructed in accordance with the teaching of the instant invention, the minimum sustain voltage with a 10 atomic percent lithium concentration was 84 volts; the maximum sustain voltage was 97 volts, while for MgO alone the maximum and minimum sustain voltages were 90 and 80 volts respectively. In the above described preferred embodiment, the constituent magnesium and lithium oxides were co-evaporated using two separate electron guns to provide better control of the relative concentrations of the two oxides comprising the overcoat layer.

With respect to material having a high secondary electron emission efficiency, the dominant secondary electron production mechanism is defined as emission from the confining boundaries of the gas, which in the instant invention are the dielectric surfaces. The breakdown voltage in a gaseous discharge display panel is determined by the electron amplification in the gas volume defined by the coefficient $\alpha$ and the production of secondary electrons at the confining surfaces or cell walls defined by the coefficient $\gamma$. For a specified gas mixture, pressure and electrode spacing, $\alpha$ is a monotonically increasing function of the voltage in the ordinary range of panel operation. The secondary electron emission is characterized by a coefficient $\gamma$, which is a function of the surface material and mode of preparation. Voltage breakdown occurs when the following approximate-relationship is satisfied:

$$\gamma e^{\alpha d} \approx 1$$

where d is the spacing between electrodes. Consideration of the above equation shows that an increase in $\gamma$ will result in a lower value of $\alpha$ at breakdown, and hence a lower breakdown or panel operating voltage $V_b$. $V_{s\ max.}$ is a function of $\gamma$ while $V_{s\ min.}$ is primarily determined by wall charge. Thus the use of lithium doped magnesium oxide increases $V_{s\ max.}$ at a relatively high rate, while $V_{s\ min.}$ remains essentially constant or increases at a slower rate to provide increased memory margin. In a gas panel constructed in accordance with the teaching of the instant invention, having a lithium magnesium oxide overcoat, a graph of $\Delta V_s$ vs. the square root of time in terms of hours, the panel tested indicated a deviation of less than one-half volt at 1,000 hours. The fabrication process of the panel involved outgassing the panel plates in a vacuum at 350° C. for one hour and then cooling the panel plates in vacuum to room temperature with the lithium-magnesium oxide film deposited at room temperature. A similar graph of a magnesium oxide coated plate tested under identical conditions indicated a deviation in $\Delta V_s$, of about $-2.5$ volts, a substantial difference in terms of the nominal margin values.

Referring now to FIG. 2, a top view is employed to clarify certain details of the instant invention, particularly since only a portion of the panel as shown in cutaway in FIG. 1. Two rigid support members or substrates 27 and 29 comprise the exterior members of the display panel, and in a preferred embodiment comprise ¼" commercial grade soda-lime-silica glass. Formed on the inner walls of the substrate members 27 and 29 are the horizontal and vertical conductor arrays 25, 23, respectively. The conductor sizes and spacing are obviously enlarged in the interest of clarity.

In typical gas panel configuration, the center-to-center conductor spacing in the respective arrays is between 14 and 60 mils using 3–6 mil wide conductors which may be typically 2.5 microns in thickness. Formed directly over the conductor arrays 25, 23 are the dielectric layers 33 and 35 respectively which, as previously described, may comprise solder glass such as lead-borosilicate glass containing a high percentage of lead oxide. The dielectric members, being of nonconductive glass, function as insulators and capacitors for their associated conductor arrays. Lead-borosilicate glass dielectric is preferred since it adheres well to other glasses, has a lower reflow temperature than the soda-lime-silicate glass substrates on which it is laid, and has a relatively high viscosity with a minimum of interaction with the metallurgy of the conductor arrays on which it is deposited. The expansion characteristics of the dielectric must be tailored to that of the associated substrate members 27 and 29 to prevent bowing, cracking or distortion of the substrate. As an overlay or a homogeneous film, the dielectric layers 33 and 35 are more readily formed over the entire surface of the gaseous discharge device rather than cell-by-cell definition.

The lithium doped MgO overcoating the associated dielectric layers is shown on FIG. 2 as layers 39, 41 which, as previously noted, combine a high secondary electron emission efficiency with a resistance to aging during normal panel operations. As in the dielectric layer with respect to the substrate, the overcoating layers 39 and 41 are required to adhere to the surface of the dielectric layers and remain stable under panel fabrication including the high temperature baking and evacuation processes. A 3000 Angstrom thick coating is used in the preferred embodiment. While the lithium doped magnesium oxide coating in the above described embodiment of the instant invention was applied over the entire surface, it will be appreciated that it could be also formed on a site-by-site definition.

The final parameter in the instant invention relates to the gas space or gap 45 between the opposing lithium magnesium oxide surfaces in which the gas is contained. This is a relatively critical parameter of the gas panel, since the intensity of the discharge and the interactions between discharges on adjacent discharge sites are functions of the spacing. While the size of the gap is not shown to scale in the drawings, a spacing of approximately 5 mils is utilized between cell walls in the preferred embodiment. Since a uniform spacing distance must be maintained across the entire panel, suitable spacer means, if needed, could be utilized to maintain this uniform spacing. While the gas is encapsulated in the envelope, additional details regarding sealing of the panel or fabrication details such as the high temperature bakeout, evacuation and backfill steps have been omitted as beyond the scope of the instant invention. However, details on these features are fully described in the aforereferenced U.S. Pat. No. 3,837,724.

While the invention has been described in terms of a preferred embodiment of lithium doped magnesium oxide, it may also be implemented by doping of magnesium oxide overcoat with elements of Group VIB and Group VIII resulting in a further improved panel stability during aging. For example, doping the magnesium oxide coating with 0.1 to 0.5 percent by weight of Chromium (Group V1B element) iron or nickel (Group VIII elements) results, on the other hand, in only a slight increase in the maximum and minimum sustain voltage of both the aged and unaged discharge cells during aging. In addition, doping the magnesium oxide overcoat with lithium (Group IA element) or with lithium and iron (Group VII element) results in essentially no change in the maximum and minimum sustain during aging.

In summary, doping the magnesium oxide coating of a gas panel with lithium results in essentially no change in the maximum and minimum sustain during aging. Doping the magnesium oxide with Group VIB and Group VIII results in an improved panel stability during aging. For a given gas pressure, the incorporation of lithium into MgO causes the maximum sustain voltage to increase while the minimum sustain voltages increase, if any, is only nominal, thereby enhancing, the panel margin. The instant invention this increases the panel margin and maintains the margin during operation, eliminating the aging problem in gas panel operation.

While the invention has been particularly shown and described with reference to preferred embodiments thereof, it will be understood by those skilled in the art that other changes in form and detail may be made therein without departing from the spirit and scope of the invention.

What is claimed is:

1. In a gaseous discharge display/memory device characterized by an ionizable gaseous medium in a gas chamber formed by a pair of dielectric material bodies having opposed wall charge storage surfaces, the improvement wherein each dielectric surface is coated with an electron emissive substance to provide low operating voltage, refractory properties and stable operating margins, said electron emissive substance being selected from a combination of lithium and one Group IIA oxide.

2. A device of the type claimed in claim 1 wherein said Group IIA oxide comprises magnesium oxide.

3. A device of the type claimed in claim 2 wherein said magnesium oxide is doped with a lithium oxide having a concentration of 5 to 40 atomic percent relative to said magnesium oxide.

4. A device of the type claimed in claim 3 further including minute amounts of Group VIB elements.

5. A device of the type claimed in claim 4 wherein said Group V1B elements include chromium.

6. A device of the type claimed in claim 3 further comprising minute amounts of Group VIII elements.

7. A device of the type claimed in claim 6 wherein said Group VIII elements include iron and nickel.

8. In a gaseous discharge display device, the combination comprising an ionizable gaseous medium, a pair of conductive support members, conductor arrays formed on each of said support members, and a dielectric medium insulating at lease one of said conductor arrays from contact with said gaseous medium, a dielectric overcoat formed over said dielectric medium, the gaseous medium contacting surface of said electric overcoat comprising a lithium doped alkaline earth oxide in an amount sufficient to increase and stabilize the memory margin of said device while eliminating aging effects and extending the life of said gaseous discharge display device.

9. Apparatus of the type claimed in claim 8 wherein said alkaline earth oxide comprises magnesium oxide.

* * * * *